US006023789A

United States Patent [19]

Wilson et al.

[11] Patent Number: 6,023,789

[45] Date of Patent: Feb. 15, 2000

[54] SPORTS SHORT

[76] Inventors: Douglas A. Wilson, 151 Kingscross Drive, King City, Ont. L7B 1E6, Canada; Anthony Torr, 5 Kearsey Drive, Barrie, Ont. K4N 4R8, Canada

[21] Appl. No.: 09/107,303

[22] Filed: Jun. 30, 1998

[51] Int. Cl.[7] ..... A41B 9/02

[52] U.S. Cl. ..... 2/228; 2/238; 2/404; 2/405; 2/408; 450/100

[58] Field of Search ..... 2/243.1, 227, 238, 2/228, 400–408; 450/100–104, 115, 116; 502/70–72

[56] References Cited

U.S. PATENT DOCUMENTS

| | | | |
|---|---|---|---|
| 3,035,586 | 5/1962 | Bell | 450/100 |
| 3,060,938 | 10/1962 | Kattermann et al. | 450/115 |
| 3,788,314 | 1/1974 | Noreen | 128/159 |
| 4,660,554 | 4/1987 | Wright | 128/158 |
| 4,811,427 | 3/1989 | Regan | 2/227 |
| 5,131,100 | 7/1992 | Atwater et al. . | |
| 5,136,727 | 8/1992 | Brisco . | |
| 5,201,074 | 4/1993 | Dicker . | |
| 5,255,393 | 10/1993 | Brady | 450/115 |
| 5,291,617 | 3/1994 | Moretz et al. | 2/400 |
| 5,392,467 | 2/1995 | Moretz et al. | 2/400 |
| 5,598,586 | 2/1997 | Munjone . | |
| 5,689,836 | 11/1997 | Fee et al. | 2/465 |
| 5,819,323 | 10/1998 | Edenfiled | 2/466 |

OTHER PUBLICATIONS

Duke Catalogue (Front cover), Royal Textile Mills, Inc., 1992.

*Primary Examiner*—Gloria M. Hale
*Assistant Examiner*—Tejash Patel
*Attorney, Agent, or Firm*—Dinsmore & Shorl LLP

[57] ABSTRACT

The present invention is directed to a sports short adapted to provide compressive support to the body portions covered thereby, the short comprises an elastic waistband adapted to encircle the waist of a wearer; a body portion formed of a stretchable, compressive material, the body portion comprises a pair of tubular legs having varying circumferential proportions with respect to the waistband to provide the proper maximal compression to the various muscles and decrease muscular vibration, each tubular leg having an upper end region attached to the waistband; a crotch panel continuous from a front portion of the waistband to a back portion of the waistband, the crotch panel being attached at each side to each tubular leg, the crotch panel having a front elongate v-shaped portion attached at a top free end to a front side of the waistband and a back elongate v-shaped portion attached at the other top free end to the back side of the waistband, the back v-shaped portion being generally narrower than the front v-shaped portion; and a non deteriorating moisture control means for removing moisture away from the skin of a wearer.

13 Claims, 3 Drawing Sheets

SPORTS SHORT

FIELD OF THE INVENTION

This invention relates to an athletic garment. More specifically, the present invention relates to athletic shorts which provide compressive support particularly to the thigh muscles as well as the pelvic and buttock regions in a comfortable and moisture controlled manner to increase comfort and athletic performance.

BACKGROUND OF THE INVENTION

Several different types of athletic shorts have been designed which are adapted for covering the lower trunk and upper legs of the wearer. In addition, several of these shorts are constructed of a stretchable or elastic knit fabric for the provision of some degree of compressive support for the wearer.

For example, U.S. Pat. No. 5,201,074 is directed to exercise shorts giving exercise to leg muscles. The shorts are made of a synthetic fibre material such as spandex containing 85% polyurethane with resilient reinforcing for increasing resistance to a wearer's muscle action. The shorts have an open waist and legs, a draw string, first and second extensible elastic resistive bands fastened at the back vertical midline in an inverted V-shape and spirally encircling respective legs above the knee.

U.S. Pat. No. 5,136,727 is directed to an exercise short having a ventilating portion of light weight permeable open mesh woven fabric made from cotton, polyester, nylon, etc., allowing for rapid heat transfer from the pelvic region. An optional outer shell may be placed over the pelvic region and a pair of form fitting resilient tubular portions for partly covering the legs.

U.S. Pat. No. 5,598,586 discloses a pair of adjustable athletic shorts having a nylon outer shell and a spandex inner shell. The front elastic waistband has an adjustable two piece strap and a front vertical opening which is closable by hook and loop fasteners. Pockets arc provided in the front anti rear panels and releasably coupleable straps are located on the lower periphery.

U.S. Pat. No. 5,131,100 discloses an athletic compression short which comprises an elastic waistband, a pair of tubular legs formed of stretchable elastic knit fabric which are attached at the upper ends to the waistband and a crotch panel means formed of stretchable elastic knit fabric wherein the front panel of the crotch panel means comprises an open mesh warp knit construction and the rear panel of the crotch panel means comprises a plain warp knit construction.

While these types of shorts are suitable for athletic wear and do provide some compressive support for thigh muscles, they are not particularly suitable for wear during very active sports in which an athlete may excessively sweat and in this manner create wet, sweat-soaked shorts which no longer offer the proper compressive support to the muscles of the wearer. These shorts also do not offer any means for providing additional protection of the genital area as they are not adapted for use with genital protectors. Furthermore, the general design of shorts causes the loss of elasticity over time creating bunching up of fabric in the crotch area and general discomfort.

U.S. Pat. No. 4,811,427 discloses an athletic garment comprising two layers of pant, suitable for hockey players as the garment provides a means for protection for the genital area. The garment comprises a waistband, an outer pant supported from the waistband having an outer crotch portion with an outer pocket for receiving and retaining a genital protector and an inner pant located within the outer pant. The inner pant has a shorter inseam than the outer pant. While this garment provides support protection of the genital area, it does not simultaneously provide compressive support to the thigh muscles or the pelvic and buttock region. It also does not provide complete and comfortable freedom of movement while maintaining muscular compressive support without excessive movement of the genital protector, nor does it provide any moisture control for removing sweat away from the body.

There was therefore a need to develop and design a sports short which not only provides The proper amount of compressive support for the various regions of muscles (i.e. thigh, buttock, lower abdominals) but also simultaneously provides moisture control during exercise in order to provide comfort To the wearer as well as continual and adequate compression to the muscles. It was also important to develop such a sports short which could also be adapted to provide proper support and protection of the genital area and/or used for support of other sports apparel such as stockings as used in hockey.

SUMMARY OF THE INVENTION

In accordance with the present invention there is provided a novel sports short adapted to provide compressive support to the body muscles covered thereby, said short comprising; an elastic waistband adapted to encircle the waist of a wearer; a body portion formed of a stretchable, compressive material, said body portion comprising a pair of tubular legs having varying circumferential proportions with respect to the waistband to provide the proper maximal compression to the various muscles and decrease muscular vibration, each tubular leg having an upper end region attached to said waistband, a crotch panel continuous from a front portion of the waistband to a back portion of the waistband, said crotch panel being attached at each side to each tubular leg, said crotch panel having a front elongate v-shaped portion attached at a top free end to a front side of the waistband and a back elongate v-shaped portion attached at the other top free end to the back side of the waistband, the back v-shaped portion being generally narrower than said front v-shaped portion; and a non deteriorating moisture control means for removing moisture away from the skin of a wearer.

In another embodiment, a genital support and protector means is incorporated in the design of the sports short comprising a pouch positioned on the inside of the front elongate v-shaped portion of the crotch panel which can be reversibly opened and closed to retain a genital protector. The genital support and protector means properly positions and restrains a genital protector in a comfortable manner for the wearer.

In yet another embodiment of the invention, the sports shorts may also be designed to have a plurality of fastening means positioned on areas of the tubular legs for attachment of additional athletic wear such as hockey stockings.

The sports short of the present invention is well adapted for use by both men and women participating in a multitude of sports activities which require that the muscles, particularly thigh muscles, be adequately supported for peak performance with decreased muscle fatigue and injury. The sports shorts therefore act to help enhance overall athletic performance. For men, the design of the sports short helps to provide comfortable support of the muscles as well as the genital area and may also be designed to retain a genital protector in place in the proper position without obstruction of freedom of movement. In addition, the elastic compressive nature of the fabric also has a non-deteriorating moisture control system which helps to remove perspiration from the skin to keep the skin feeling drier and thus more comfortable. This also helps to reduce bacterial growth on the skin and thus may prevent conditions such as jock itch. Lastly, the shorts are designed such that they are easy to size and comfortable for all different body sizes and shapes. In particular, the legs are designed having varying circumferential proportions with respect to the waistband to provide the proper maximal compression to the various muscles. This acts to take into account the various ratios of waist to thigh sizes of a wearer and helps to provide varying amounts of compression to the thigh versus the buttocks or lower abdominal muscles.

BRIEF DESCRIPTION OF THE DRAWINGS

A detailed description of the preferred embodiments are provided herein below with reference to the following drawings in which.

Figure 1:
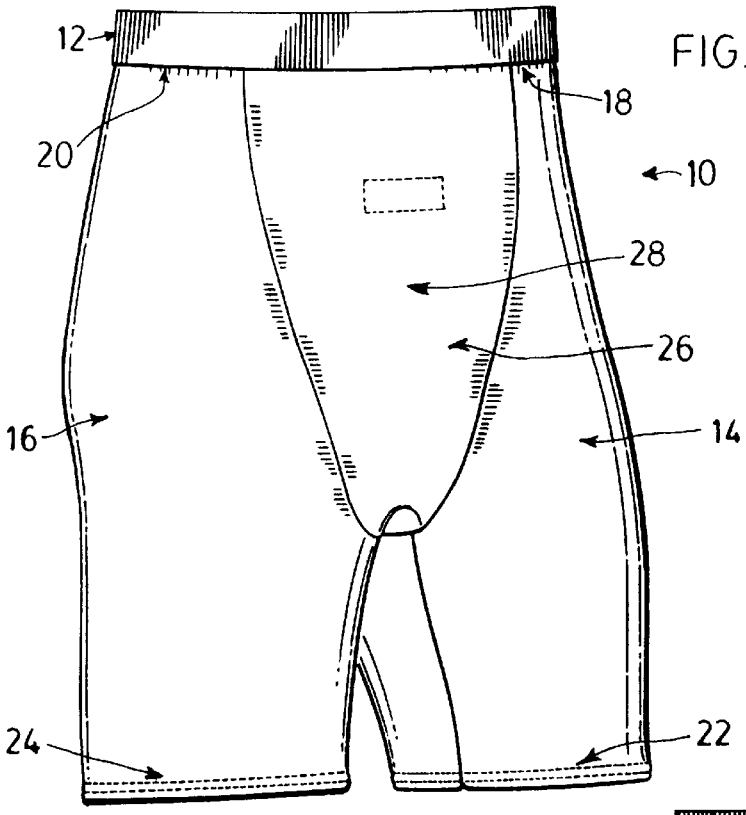
FIG. 1 is a front perspective view of the sports shorts of the present invention.

In the drawings, preferred embodiments of the invention are illustrated by way of example. It is to be expressly understood that the description and drawings are only for the purpose of illustration and as an aid to understanding, and are not intended as a definition of the limits of the invention.

DETAILED DESCRIPTION OF THE PREFERRED EMBODIMENTS

Figure 2:
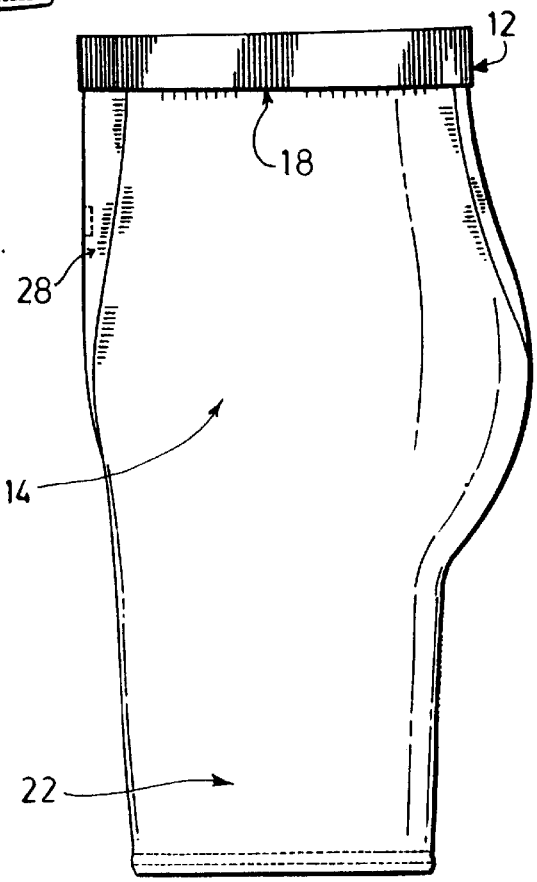
FIG. 2 is a side elevational view of the sports shorts of FIG. 1, the other side being a mirror image thereof.

As seen in FIG. 1, the sports short of the present invention is shown and generally indicated as reference numeral 10. The shorts have an elastic waist band 12 which encircles the waist of the wearer. The waist band 12 can be made of varying circumferences to fit different sized waists. The waistband can also be made of varying widths such as for example from about 1" to 3". The body portion of the shorts comprise a pair of tubular legs 14, 16. As seen in FIGS. 1 and 2, each tubular leg 14, 16 has an upper region 18, 20 which is attached at a location to the waistband 12. The lower regions 22, 24 of each tubular leg are adapted to encircle the thighs of the wearer and define lower leg openings. While the tubular leg portions are shown to be mid-length, it is understood that the tubular leg portions can be made of varying lengths so long as they provide adequate compressive support for the thigh muscles during exercise. The tubular leg portions are designed to have varying circumferential proportions with respect to the waistband in order to provide the proper amount of compressive support specifically to the thigh muscles. As athletes have varying sizes of waist and thigh circumferences, this is advantageous for the proper fit and support of the different muscles (i.e. thigh, buttock, lower abdominals) during exercise and thus may enhance athletic performance and reduce muscular vibration, fatigue and injury.

Figure 3:
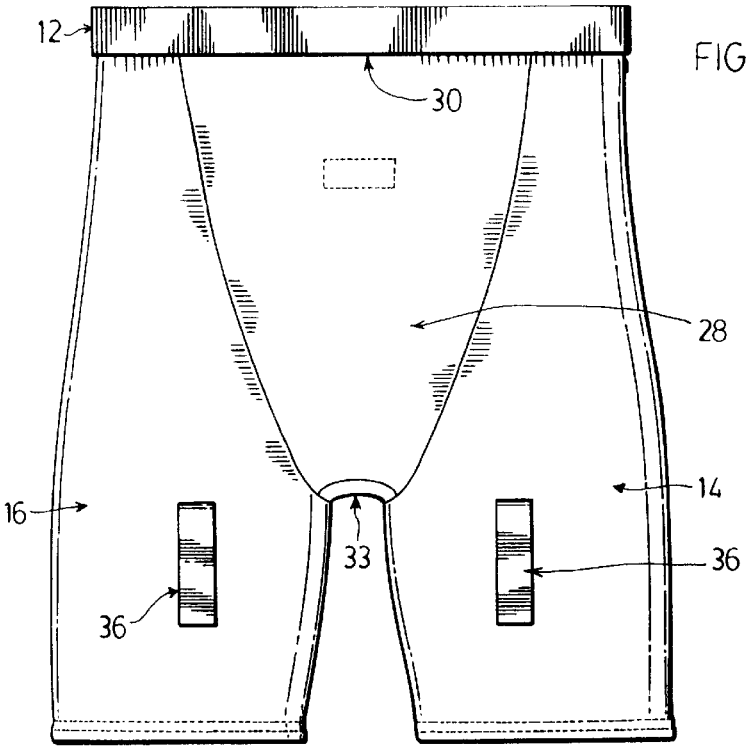
FIG. 3 is a front elevational view of a further embodiment of the sports shorts of FIG. 1.
Figure 4:
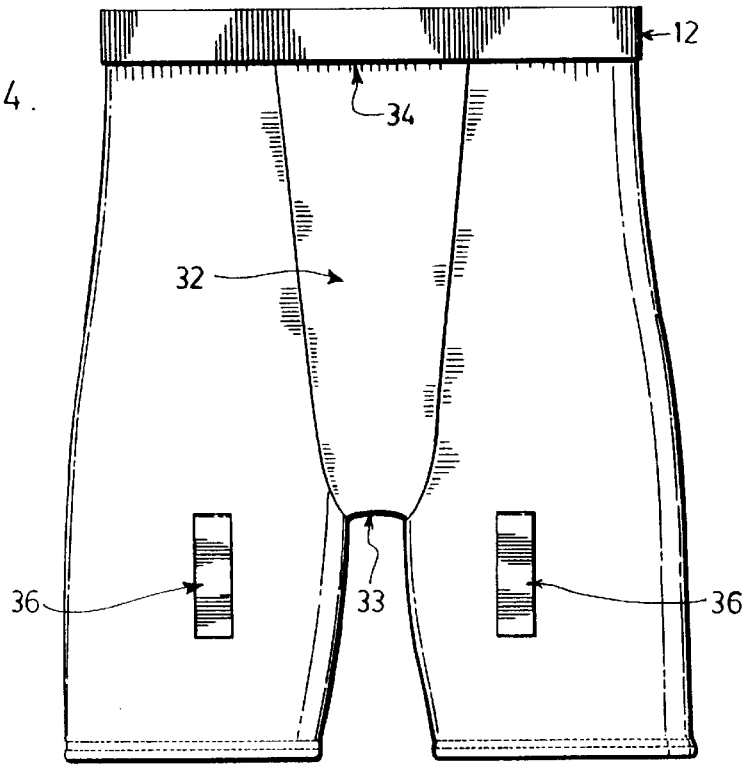
FIG. 4 is a back elevational view of the sports shorts of FIG. 3.

A continuous crotch panel 26 is provided and attached at each side to each tubular leg 14, 16. As better seen in FIG. 3, the crotch panel 26 has a front elongate v-shaped portion 28 attached at its top free end 30 to the waistband 12. As seen in FIG. 4, the crotch panel has a back elongate v-shaped portion 32 attached at its top free end 34 to the back side of the waistband 12. As can be seen from FIGS. 3 and 4, The front portion of the crotch panel is substantially larger and wider than the back portion of the crotch panel. This helps to prevent bunching of the shorts during movement. While the crotch panel is shown to be formed of a continuous single sheet of material, it is also understood that it can be made in separate pieces and joined at the lowermost portion of the crotch 33 by stitching thus forming a seam.

It is preferred that the body portion of the shorts be made from an elastic material containing at least 34% spandex fibers, such as those sold under the trademark LYCRA™ and polyester. Most preferably, The polyester has a built-in non-deteriorating moisture transfer system which helps to remove sweat away from the skin. This system is provided by means of special treatment of the polyester. One such treatment is a permanent moisture transportation technology that wicks moisture away from the body to keep it dry, such as that sold under the trademark INTERA™. This enhances the comfort of the shorts during intensive exercise as the moisture is moved away from the skin providing a drier, more comfortable feel. This also helps the muscles stay drier and warmer as they no longer are bathed in sweat which as it evaporates from the skin, leaves the muscles feeling cold and therefore prone to cramping. The moisture control of the shorts also helps to decrease the growth of bacteria on the skin. This is particularly advantageous in the crotch area of the shorts where bacterial growth can lead to jock itch and related undesirable conditions. Furthermore, the material is also odor-resistant providing obvious advantages. The design of the V-shape of the front and back portions of the crotch panel, together with the moisture transfer system help to move moisture away from the crotch area, which provides additional comfort for male wearers of the shorts. It is understood by those skilled in the art that the fabric used to form the body portion of the shorts of the present invention provides the required amount of compression to the muscles, thigh muscles in particular to help support the muscles during exercise, decrease muscular vibration and thus help athletic performance. Also, the material and design is such that bunching of the fabric in the crotch area does not occur and moisture is also removed from the crotch area to provide a drier feel. Furthermore, the shorts do not lose their moisture control capabilities, compression capabilities or shape when repeatedly laundered or worn for a long duration of time.

In another embodiment of the invention shown in FIGS. 1 to 4, the sport short may be designed to have a plurality of fasteners 36 located on the front and back portions of the tubular legs. The fasteners are preferably folded pieces of hook and loop material, such as that sold under the trademark VELCRO™, adhered to the fabric by stitching or with a suitable fabric adhesive. The fasteners act to help support leggings or stockings such as those used in hockey. Such stockings or leggings are typically made of a wool or like material and are drawn up and over the lower leg openings of the tubular legs. While it is preferred that hook and loop material fasteners be used on the shorts it is also understood that other types of fasteners such as small hooks may also be adhered to the tubular legs of the shorts.

Figure 5:
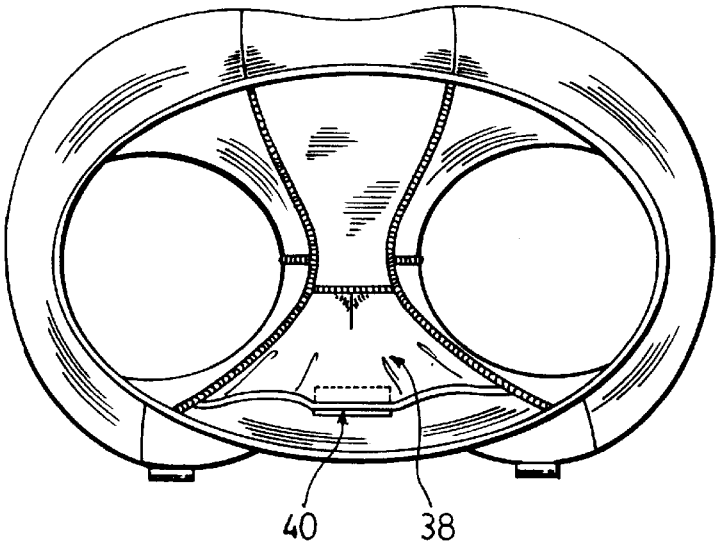
FIG. 5 is a top plan view of yet another embodiment of the sports shorts of FIG. 1 in an expanded condition and removed from the wearer showing a genital protector support means in a closed position.
Figure 6:
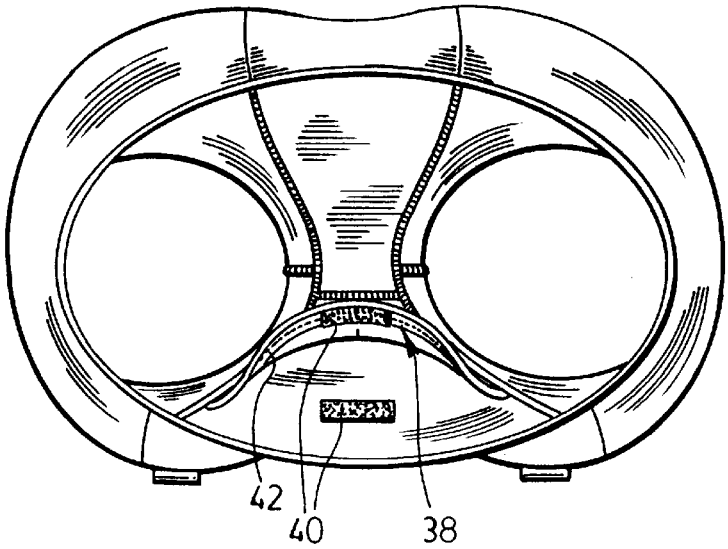
FIG. 6 is a top plan view of the sports shorts of FIG. 5 in an expanded condition and removed from the wearer showing the genital protector support means in an open position.

Another embodiment of the invention is shown in FIGS. 5 and 6 where a pocket 38 is provided and positioned on the inside front elongate v-shaped portion of the crotch panel. The pocket 38 is designed forwardly of the genital area and overlays the genitals when the short is worn by a wearer. The pocket 38 is shaped to retain a protective cup of a selected size. The pocket 38 can be opened (as seen in FIG. 6) to receive a cup or closed (as seen in FIG. 5) to retain a cup in proper position. A fastener 40, preferably hook and loop material, is adhered to the front inside V-shaped portion of the crotch panel as well as on the flap portion 42 of the pocket. Both portions of the fastener 40 can be mated to hold the pocket in the closed position. The pocket can be provided within the shorts, either with or without the additional fasteners located on the tubular legs. The provision of a pocket and/or fasteners is dependent upon the sport practised by the wearer. The pocket is also made of the same fabric as the rest of the shorts and therefore also provides the removal of moisture directly from the crotch area.

The moisture control system utilized in the design of the shorts together with the design of a pocket within the shorts, helps to comfortably support muscles and correctly position the protective genital cup within the pouch for protection of the genitals in a dry, comfortable and unobtrusive manner allowing full freedom of movement. The compression provided by the material also helps to minimize the movement of the protective genital cup when in place.

In summary, the sports short of the present invention has a novel and smooth design which is particularly suitable for wear by athletes participating in various sports and can be worn by both men and women. The shorts can also be adapted for use by men in those sports where genital protection is required such as in hockey which requires both muscular support and genital protection. The sports short can be easily put on or removed from a wearer's body. The design of the crotch panel together with the varying circumferential proportions of the tubular legs with respect to the waistband and moisture control system provide a comfortable fit and drier feel for the wearer than sports shorts of the prior art. Furthermore, the design of the shorts provide varying amounts of compression To the different muscular areas in order not to "overcompress" a given muscle group and lead to any detrimental effects. As such, the thigh muscles may be less or more compressed Man the buttock or lower abdominal muscles, as required. The moisture control system for the body portion of the shorts also provides advantages to the wearer to remove sweat away from the skin including the genital area and thus provide a drier more comfortable feel and the reduction of bacterial growth on the skin. Also, where an inside pouch is provided, it is easily opened and closed for insertion and removal of protective cups used in sports.

Although preferred embodiments have been described herein in detail, it is understood by those skilled in the art that variations may be made thereto without departing from The scope of the invention or the spirit of the appended claims.

I claim:

1. A sports short adapted to provide compressive support to the body portions covered thereby, said short comprising;

an elastic waistband adapted to encircle the waist of a wearer;

a body portion formed of a stretchable, compressive material, said body portion comprising;

a pair of tubular legs having varying circumferential proportions with respect to the waistband to provide the proper maximal compression to thigh muscles and decrease muscular vibration, each tubular leg having an upper end region attached to said waistband;

a crotch panel continuous from a front portion of the waistband to a back portion of the waistband, said crotch panel being attached at each side to each tubular leg, said crotch panel having a front elongate v-shaped portion attached at a top free end to a front side of the waistband and a back elongate v-shaped portion attached at the other top free end to the back side of the waistband, the back v-shaped portion being generally narrower than said front v-shaped portion; and a non deteriorating moisture control means for removing moisture away from the skin of a wearer.

2. The sports short as claimed in claim 1, wherein said shorts additionally comprise a plurality of fasteners positioned on the tubular legs.

3. The sports short as claimed in claim 2, wherein said fasteners comprise hook and loop material.

4. The sports short as claimed in claim 1, wherein a pocket is positioned on an inside front portion of said crotch panel.

5. The sports short as claimed in claim 4, wherein pocket fasteners are positioned on the opposing portions of the pocket and the front crotch panel.

6. The sports short as claimed in claim 5, wherein said pocket fasteners comprise hook and loop material.

7. A sports short adapted to provide compressive support to the body portions covered thereby, said short comprising;

an elastic waistband adapted to encircle the waist of a wearer;

a body portion formed of a stretchable, compressive material, said body portion comprising;

a pair of tubular legs having varying circumferential proportions with respect to the waistband to provide the proper maximal compression to thigh muscles and decrease muscular vibration, each tubular leg having an upper end region attached to said waistband;

a crotch panel continuous from a front porch of the waistband to a back portion of the waistband, said crotch panel being attached at each side to each tubular leg, said crotch panel having a front elongate v-shaped portion attached at a top free end to a front side of the waistband and a back elongate v-shaped portion attached at the other top free end to the back side of the waistband, the back v-shaped portion being generally narrower than said front v-shaped portion;

a non deteriorating moisture control means for removing moisture away from the skin of a wearer;

wherein said shorts additionally comprise a plurality of fasteners positioned on the tubular legs; and wherein a pocket is positioned on an inside front portion of said crotch panel.

8. A method of providing maximal compression to thigh muscles comprising the step of wearing a sports short comprising a waistband and a body portion;

wherein the body portion is formed from a stretchable, compressible, material; and comprises:

a pair of tubular legs having varying circumferential proportions with respect to the waistband, each tubular leg having an upper end region attached to the waistband;

a crotch panel attached to each side of each tubular leg and to the waistband, wherein the crotch panel has a front elongate v-shaped portion and a back elongate v-shaped portion which is narrower than the front v-shaped portion.

9. A method according to claim 8, wherein the material comprises spandex, polyester, and a moisture transfer system.

10. A method according to claim 8, wherein the sports short further comprise a pouch positioned on the inside of the front elongate v-shaped portion of the crotch panel.

11. A method according to claim 8, further comprising the step of placing a genital protector in the pouch.

12. A method according to claim 8, wherein the sports short further comprises a plurality of legging fasteners positioned on the tubular legs.

13. A method according to claim 8, wherein pouch fasteners are positioned on the opposing portions of the pouch and the front crotch panel.

* * * * *